US011697528B2

(12) United States Patent
Dahlin et al.

(10) Patent No.: US 11,697,528 B2
(45) Date of Patent: Jul. 11, 2023

(54) SEALING ARRANGEMENT FOR PACKAGING CONTAINER

(71) Applicant: AR Packaging Systems AB, Lund (SE)

(72) Inventors: Kajsa Dahlin, Vällingby (SE); Simon Holka, Staffanstorp (SE); Maximilian Lundgren-Goodman, Lomma (SE)

(73) Assignee: GPl Systems AB, Lund (SE)

( * ) Notice: Subject to any disclaimer, the term of this patent is extended or adjusted under 35 U.S.C. 154(b) by 10 days.

(21) Appl. No.: 16/968,418

(22) PCT Filed: Feb. 6, 2019

(86) PCT No.: PCT/SE2019/050099
§ 371 (c)(1),
(2) Date: Aug. 7, 2020

(87) PCT Pub. No.: WO2019/156617
PCT Pub. Date: Aug. 15, 2019

(65) Prior Publication Data

US 2020/0399027 A1 Dec. 24, 2020

(30) Foreign Application Priority Data

Feb. 9, 2018 (SE) ..... 1850146-0

(51) Int. Cl.
*B65D 43/16* (2006.01)
*B65D 43/22* (2006.01)
*B65D 51/18* (2006.01)

(52) U.S. Cl.
CPC ..... *B65D 43/161* (2013.01); *B65D 43/22* (2013.01); *B65D 51/18* (2013.01);
(Continued)

(58) Field of Classification Search
CPC ..... B65D 2251/0093; B65D 2251/20; B65D 41/169; B65D 51/18; B65D 51/20;
(Continued)

(56) References Cited

U.S. PATENT DOCUMENTS 1,249,095 A * 12/1917 Hulbert ..... B31B 50/00 229/5.6
2,681,742 A 6/1954 Miller
(Continued)

FOREIGN PATENT DOCUMENTS

CN 86104594 A 6/1987
CN 105836310 A 8/2016
(Continued)

OTHER PUBLICATIONS

International Preliminary Report on Patentability for PCT/SE2019/050099 completed on Jan. 7, 2020, 6 pages.
(Continued)

*Primary Examiner* — Jennifer Robertson
*Assistant Examiner* — John Martin Hoppmann
(74) *Attorney, Agent, or Firm* — Womble Bond Dickinson (US) LLP

(57) ABSTRACT

A paperboard packaging container includes a sealing arrangement comprising a lid and a sealing rim. The packaging container further includes a circumferential lid sealing member applied in the lid. The sealing rim forms a closed loop extending around the container opening. The sealing rim further comprises a first sealing surface arranged at an upper end edge of the sealing rim and is arranged to seal against a second sealing surface constituted by the circumferential lid sealing member when the lid is in a closed position. The sealing arrangement furthermore includes a frame structure forming a closed loop extending around a periphery of the container opening and is connected to the
(Continued)

sealing rim. The lid is connected to the frame structure by a hinge member and a locking arrangement.

19 Claims, 5 Drawing Sheets

(52) U.S. Cl.
CPC ..... *B65D 2251/0021* (2013.01); *B65D 2251/023* (2013.01); *B65D 2543/00296* (2013.01); *B65D 2543/00435* (2013.01); *B65D 2543/00981* (2013.01)

(58) Field of Classification Search
CPC ..... B65D 51/346; B65D 51/247; B65D 2543/00435; B65D 2543/00981; B65D 21/023; B65D 3/14; B65D 2543/00564; B65D 53/04; B65D 43/0266; B65D 2543/00296; B65D 2543/00268; B65D 2543/00537; B65D 2543/00962; B65D 2543/00101; B65D 2543/0024; B65D 51/24; B65D 51/246; B65D 43/169; B65D 43/166; B65D 43/164; B65D 43/14; B65D 41/185; B65D 41/045; B65D 43/165
USPC ..... 215/350, 349, 232, 341, 343, 344, 351; 220/258.2, 324, 125.08; 15/344
See application file for complete search history.

(56) References Cited

U.S. PATENT DOCUMENTS

| | | | | |
|---|---|---|---|---|
| 3,971,489 | A | 7/1976 | Welch et al. | |
| 4,620,640 | A | 11/1986 | Swartzbaugh | |
| 5,687,865 | A | 11/1997 | Adams et al. | |
| 5,810,188 | A * | 9/1998 | Novakoski | E05C 3/048 215/237 |
| 6,050,441 | A | 4/2000 | Kuo | |
| 2004/0055992 | A1 | 3/2004 | Robinson et al. | |
| 2009/0230177 | A1 * | 9/2009 | Robertson | B65D 43/165 229/123.3 |
| 2012/0037213 | A1 * | 2/2012 | Cheng | H01L 31/049 136/251 |
| 2015/0251826 | A1 | 9/2015 | Lee et al. | |
| 2016/0000270 | A1 | 1/2016 | Wiggins et al. | |
| 2016/0177045 | A1 * | 6/2016 | Krist | C08L 23/08 521/149 |
| 2017/0247151 | A1 | 8/2017 | Chiou | |
| 2018/0016038 | A1 | 1/2018 | Herlin et al. | |
| 2018/0020876 | A1 | 1/2018 | Herlin et al. | |

FOREIGN PATENT DOCUMENTS

| | | | | |
|---|---|---|---|---|
| CN | 105857880 | A | 8/2016 | |
| CN | 106061856 | A | 10/2016 | |
| CN | 107000856 | A | 8/2017 | |
| CN | 107406172 | A | 11/2017 | |
| DE | 202005009426 | U1 | 8/2005 | |
| EP | 2399840 | A1 * | 12/2011 | B65D 41/045 |
| JP | 3153084 | U * | 8/2009 | B65D 15/08 |
| KR | 200385831 | Y1 * | 6/2005 | B65D 51/246 |
| TW | 201425157 | A | 7/2014 | |
| WO | WO-0234824 | A2 * | 5/2002 | C08J 9/14 |
| WO | 2016126191 | A1 | 8/2016 | |
| WO | 2016126193 | A1 | 8/2016 | |
| WO | WO-2016195616 | A1 * | 12/2016 | B65D 51/246 |
| WO | 2017204731 | A1 | 11/2017 | |
| WO | WO-2017204731 | A1 * | 11/2017 | B65D 43/22 |

OTHER PUBLICATIONS

International Search Report for Application No. PCT/SE2019/050099 dated Apr. 12, 2019, 4 pages.
Swedish Search Report for Application No. 1850146-0 dated Oct. 25, 2018, 3 pages.
Chinese Search Report for Application No. 201980012700.3 dated Aug. 20, 2021, 2 Pages.

* cited by examiner

SEALING ARRANGEMENT FOR PACKAGING CONTAINER

CROSS-REFERENCE TO RELATED APPLICATIONS

The present application is a national phase entry under 35 U.S.C. § 371 of International Application No. PCT/SE2019/050099, filed Feb. 6, 2019, which claims priority from Swedish Patent Application No. 1850146-0, filed Feb. 9, 2018, the disclosures of which are hereby incorporated by reference in their entirety.

TECHNICAL FIELD

The invention pertains to a sealing arrangement for a packaging container, such as a packaging container for bulk solids. The packaging container is of the type comprising a container body and a sealing arrangement including a sealing rim and a lid which cooperate to close a container opening.

BACKGROUND

In the area of packaging of consumer goods, and in particular when packaging dry flowable pulverulent consumer goods it is common to use rigid paperboard packaging containers which serve as protective transport and storage containers at the retail end and as storage and dispensing containers at the consumer end. Such paperboard containers are usually provided with an openable and closable lid, and with an inner removable or breakable barrier membrane which keeps the contents fresh and protected against contamination up until delivery of the packaging container to a consumer. Once the inner barrier has been destroyed in order to access the contents in the packaging container, the ability of the packaging container to protect the contents from detrimental influence from the environment depends strongly on the lid construction. Accordingly, it is a concern that the packaging container can continue to keep the contents in the packaging container fresh and protected against contamination from the outside also after the inner barrier has been removed. It is a particular concern that the packaging container may be repeatedly opened to access the contents in the container and be re-sealed to allow hygienic storage of the contents in the package between dispensing occasions. A packaging container for bulk solids usually contains more of the packaged product than will be used at each dispensing occasion. Thus, it is desirable that the product remaining in the packaging container retains properties such as flavor, scent, scoopability, vitamin content, color, etc. at least for a duration corresponding to the time expected for a consumer to use up all the contents in the packaging container.

WO2017/204731 A1 discloses a lid component for a paperboard packaging container for bulk solids.

It is therefore an object of the present invention to offer improvements in a closure arrangement for a paperboard packaging container and in particular to offer a closure arrangement having enhanced sealing capability.

SUMMARY

One or more of the above objects may be achieved with a lid component for a paperboard packaging container for bulk solids, in accordance with claim 1 or a lid component in accordance with claim 14. Further embodiments are set out in the dependent claims, in the following description and in the drawings.

A paperboard packaging container as disclosed herein comprises a container body, the container body comprising a container wall extending from a container bottom to a container opening in a height direction of the container. The packaging container furthermore comprises a sealing arrangement comprising a lid and a sealing rim, the lid comprising a top portion and a side wall portion, the top portion having an outer lid surface and an inner lid surface opposite to the outer lid surface. The packaging container comprises a circumferential lid sealing member applied in the lid against an inner lid support surface. The sealing rim forms a closed loop extending around the container opening and is attached to an inner surface of the container wall at the container opening. The sealing rim further comprises a first sealing surface arranged at an upper end edge of the sealing rim and is arranged to seal against a second sealing surface constituted by the circumferential lid sealing member when the lid is in a closed position. The sealing arrangement furthermore comprises a frame structure forming a closed loop extending around a periphery of said container opening and being connected to the sealing rim. The lid is connected to the frame structure by a hinge member arranged at a first part of the frame structure and a locking arrangement being arranged on said frame structure at a second part of the frame structure, which is located opposite the first part of the frame structure. The locking arrangement comprises interengaging locking elements, wherein a first interengaging locking element is arranged in or on said outer lid surface of the lid top portion and a second interengaging locking element is arranged on or in a locking flap. The locking flap is arranged on the frame structure and is hingedly connected to the frame structure by means of a hinge formed integrally with, or connected to, the frame structure. The circumferential sealing member is made from a polymer foam having a closed-cell structure, has a no-load thickness $t_0$ of from 1.5 mm to 5 mm and a density of from 10 to 75 kg/m$^3$. A distance $d_1$ is defined between the first sealing surface of the sealing rim and the inner support surface of the lid when the lid is in a closed position, and wherein the distance $d_1$ is smaller than the no-load thickness $t_0$ of the circumferential lid sealing member, i.e. $t_0>d_1$. The lid sealing disc is furthermore applied in the lid with a lateral compression against the side wall portion such that lateral tension through the lid sealing disc is created.

A higher level of tightness of the container and any container seals may be desirable when the packaged goods is moisture sensitive and/or is sensitive to degradation when exposed to ambient air. It may also be desirable that the packaging container is aroma-proof in order to preserve flavours and aromas in the packaged goods and to prevent the packaged goods from taking up flavours and aromas from outside the packaging container.

The fact that $d_1<t_0$ is fulfilled for the packaging container as disclosed herein, gives a compression of the lid sealing member at the second sealing surface by means of the first sealing surface at the upper end edge of the sealing rim as disclosed herein such that a tight sealing of the packaging container is obtained. It has been found that by carefully selecting a material for the lid sealing member which is resilient, conforming, and has a thickness within the ranges as set out herein, the lid sealing member and the sealing rim may cooperate to create a sustained clamping force between the inner surface of the lid and the sealing edge on the sealing rim. Thereby, a sealing arrangement as disclosed herein can maintain a packaging container opening tightly sealed over time and after repeated openings and closures.

The sealing disc is applied in the lid with a lateral compression against the lid side wall portion such that lateral tensioning of the lid sealing disc is created. The lid side wall portion may for example comprise two transverse wall sections and two longitudinal wall sections wherein the lid sealing disc has a slightly greater longitudinal dimension than the inner lid surface, such as for example in the range of from 0.5 to 1.5 mm. The lid sealing disc may alternatively or additionally have a slightly greater transverse dimension than the inner lid surface, such as for example in the range of from 0.5 to 1.5 mm.

The fact that the lid sealing disc is applied with a slight lateral compression against the side wall portion of the lid improves the integrity of the seal between the first and the second sealing surface as it causes the lid sealing disc to slightly bulge towards the second sealing surface and the compression force against the second sealing surface at the lid sealing disc increases. Lateral tensioning of the lid sealing disc has also been found to improve recovery of the sealing disc after compression in the thickness direction.

The side wall portion of the lid may also comprise a protruding rib adapted to hold the lid sealing disc in place against the inner lid surface. The rib protrudes in a direction perpendicular to the side wall portion, and may be arranged continuously and discontinuously around the inner circumference of the side wall portion of the lid. The protruding rib may be arranged along in the range of from 75 to 100%, such as in the range of from 80 to 100% or in the range of from 90 to 100%, of the circumference of the inner side, i.e. the side facing the lid sealing member, of the side wall portion of the lid. The protruding rib may be arranged at a distance $d_2$ from the inner support surface of the lid. The distance $d_2$ may correspond to the thickness $t_0$ of the lid sealing member.

The lid sealing disc may be applied into the lid with a snap-fit against the side wall portion and under the protruding rib.

It has been found that a lid sealing member made of polyethylene closed-cell foam material having a density and thickness as disclosed herein is particularly suitable and can be selected to have the requisite physical properties of resilience, smoothness and stability.

Optionally, $t_0$ value is at least 10% greater than $d_1$, such as at least 15% greater than $d_1$. Optionally, $t_0$ is from 10% to 50% greater than $d_1$, meaning that $t_0$ is not more than 50% greater than $d_1$, such as not more than 45% greater than $d_1$.

It has been found that when $t_0$ is at least 10% greater than $d_1$, such as at least 15% greater than $d_1$, a packaging container in according to the present disclosure comprising a sealing member as disclosed herein will provide an enhanced sealing arrangement due to the compression force between the first and second sealing surface compressing the lid sealing member thereby obtaining a tight seal between the lid sealing member and the upper end edge of the sealing rim.

It has also been found by the present inventors that the recovery of the sealing member when compressing the sealing member above 50%, such as above 45%, may be affected over time such that that the efficiency of the closure arrangement may decrease over time. There is also a risk that the sealing member becomes slightly laterally displaced upon repeated openings and closures which may negatively impact the integrity of the closure arrangement. Especially if the sealing member is not completely recovered from the compression such that several compression marks remain on the sealing member.

An improved closure also over an extended time with repeated openings and closures may therefore be achieved with a lid sealing member according to the present disclosure in combination with a packaging container according to the present disclosure where $t_0$ is in the range of from 10% to 50% greater than $d_1$, such as at least 10% greater, but not more than 45% greater than $d_1$, such that not more than 30% greater than $d_1$.

Preferably, the circumferential lid sealing member is a lid sealing disc.

Optionally, the sealing member is made from cross-linked closed-cell polyethylene foam. The cross-linking may for example be achieved by high-energy radiation.

Optionally, at least 90% of the cells in the closed-cell foam have a cell-size in the range of from 0.1 to 1.2 mm in diameter, such as in the range of from 0.15 to 0.9 mm, such as in the range of from 0.2 to 0.5. Optionally at least 95% of the cells in the closed-cell foam have a cell-size in the range of from 0.1 to 1.2 mm in diameter, such as in the range of from 0.15 to 0.9 mm, such as in the range of from 0.2 to 0.5. The cell-size may be measured by Confocal Microscopy.

The fact that at least 90%, such as at least 95%, of the cells in the closed-cell foam have a cell-size in the range of from 0.1 to 1.2 mm, such as from 0.15 to 0.9 mm, such as from 0.2 to 0.5 provides a smooth sealing member surface. The application of such closed-cell foam material as a sealing member in a packaging container according to the present disclosure has been found to provide significantly enhanced sealing arrangement integrity. Resilient foam materials may have an uneven surface finish. Closed-cell foam material with smaller and more evenly distributed cell-sizes has a smoother surface finish.

A sealing member having a smooth surface in combination with the disclosed compressibility provides an effective seal between the circumferential lid sealing member and the sealing edge of the sealing rim as the even surface tightly seals against and around the first sealing surface.

Optionally, the circumferential lid sealing member has a sealing member first side and a sealing disc second side, the sealing member first side facing the inner lid surface and the sealing member second side facing away from the inner lid surface, wherein the sealing member second side has a surface roughness with a $R_a$ value of not more than ±400 micrometers (μm), such as not more than 300 micrometers (μm), such as not more than 250 micrometers (μm), such not more than 200 micrometers (μm). The sealing member first side may of course also have the same surface topography as the sealing member second side.

Just as a matter of example, the $R_a$ value may be within any of the following intervals, from 2 to 400 μm, from 3 to 300 μm, from 4 to 250 μm, from 10 to 200 μm and from 50 to 150 μm.

In this document the surface roughness parameter $R_a$ is used. $R_a$ is a well-known and established parameter for characterizing surface roughness. Just for the sake of clarity, $R_a$ is for example defined in BS EN ISO 4287:2000 British standard, identical with the ISO 4287:1997 standard. $R_a$ may be defined as the arithmetic average value of filtered roughness profile determined from deviations about a center line within an evaluation length, where its Formula may be given by:

$$R_a = \frac{1}{n}\sum_{i=1}^{n}|y_i|$$

where $y_i$ is the deviation from the center line at one location along the evaluation length of the investigated surface.

Optionally, the Compression set B ($C_{SET}$) of the lid sealing member at 25% compression under 22 h at 23° C., is between 10 and 20%, such as between 10 and 15%, as measured after ½ h recovery and according to standard method BS ISO 7212, 1998. The $C_{SET}$ is thus defined as the percentage of the original specimen thickness after it has been left in normal conditions for 30 minutes. $C_{SET}=[(t_0-t_i)/(t_0-t_n)]*100$ where $t_0$ is the original no-load thickness, $t_i$ is the sealing disc thickness after testing and to is the thickness of the specimen during the test. Test specimens for Compression set are cylindrical discs being cut out from the slab of the testing material which are to form the lid sealing member.

Optionally, the distance $d_1$ may be smaller than the thickness $t_i$, as measured at 25% compression of the lid sealing member according to BS ISO 7212, 1998, i.e. $t_i>d_1$ Optionally, the distance $d_1$ is at least 2%, such as 5%, smaller than the thickness $t_i$.

The fact that the distance $d_1$ is smaller than the thickness $t_i$, as measured at 25% compression of the lid sealing member improves the sealing capability over time and after repeated openings and closures of the lid.

The interengaging locking elements may be mating locking elements, the first interengaging locking element being a female locking element and the second interengaging locking element being a mating male locking element. Alternatively, the first interengaging locking element may be a male locking element and the second interengaging locking element may be a mating female locking element.

The lid is locked to the frame structure by means of a locking flap arranged on the frame structure. The locking flap may comprise a male locking element and a mating female locking element further being arranged in the outer lid surface of the lid top portion.

It has been found that the fact that the locking flap exerts pressure onto the lid top portion and downwards upon closure increases the compression of the sealing member at the second sealing surface and thereby increases the tightness of the seals improving the sealing capability.

The mating locking elements may include mating ridges and grooves on the locking flap and in the lid top portion and are arranged to keep the first and second sealing surfaces pressed together such that a compression of the sealing member is achieved.

The tightness of the seal formed between the circumferential lid sealing member and the sealing rim may be verified by means of a Sealing Arrangement Integrity Test, wherein the Sealing Arrangement Integrity Test includes the following steps;

a) cutting out a hole with a 2 cm hole diameter in said bottom of a paperboard packaging container according to the present disclosure,
b) placing the paperboard packaging container up-side-down with the lid being in a closed position,
c) pouring water having a temperature of 24° C. into the paperboard packaging container through the hole such that a water column of 20 mm is formed,
d) letting the paperboard packaging container stand up-side-down for 5 min.

After leaving the paperboard packaging container standing up-side-down for 5 minutes a visual inspection is performed at the seal between the first and the second sealing surfaces around the periphery of the container opening for assessment of the Sealing Arrangement Integrity, the presence of a leakage is graded according to the following scale;

0=no visual leakage
1=slight leakage penetration/drop formation at the seal
2=continuous leakage penetration at the seal.

The sealing arrangement of the paperboard packaging container according to the present disclosure has been found to define a Sealing Arrangement Integrity Value after 5 min of 0.

A circumferential lid sealing member according to the present disclosure may have a no-load thickness $t_0$ of at least 2.0 mm, such as from 2.0 to 4.0 mm. The thickness of the sealing member is thus measured with no load and by means of, for example, a micrometer. The circumferential lid sealing member may have a uniform thickness.

The thickness is of importance for the circumferential lid sealing member for providing resilience, while maintaining stability. Hence, it has been found that the thickness may be adapted to balance between these two requirements.

In the packaging container as disclosed herein, a support structure comprising a sealing member support element may be arranged on the inner surface of the lid, the sealing member support element having a height $h_1$ as measured from the inner surface of the lid. Such sealing member support element may thus form a closed loop and extend along and in parallel with the lid side wall portion. The sealing member support element may further be arranged such that when the lid is in a closed position the sealing member support element and the sealing rim exert pressure on the circumferential lid sealing member from opposite directions which will provide even further improved sealing properties of the packaging container.

To measure the distance $d_1$, the surface of the sealing member support element being in contact with the sealing disc is seen as the inner lid support surface.

The provision of a lid sealing member support element on the inner surface of the lid aids in providing better sealing, as pressure is exerted from opposing directions on the circumferential lid sealing member.

The packaging container as disclosed herein, may furthermore be provided with side support elements which bulge slightly upwards along the side edge, i.e. such that the height of the side support elements varies along a length of the side support elements and is greater at a central portion of each of the side support elements than at end portions of each of the side support elements. The provision of side support elements having a greater height in a central portion thereof may be used to compensate for differences in the bulging deformation of the lid at locations which are closer to the hinge member and the closure member than at locations further away from the hinge member and the closure member. By way of example, the lid may become deformed such that side edges of the lid are further away from the corresponding side edges of the container opening approximately half-way between the hinge member and the closure member. The provision of such side support elements may aid in promoting enhanced sealing along the side edges. It has been found that the lid may be caused to bulge slightly upwards along the side edges under the tensional forces created in the lid when the lid is closed on the container opening and the fastener element on the closure member is connected to the fastener element on the top outer surface of the lid. When the side support elements bulge slightly upwards along the side edges the height dimension $h_1$ should still fulfil the requirements along the entire length of the side support elements.

In the packaging container as disclosed herein, the container body has an outer surface opposite the inner surface and a container body edge at the container opening, the frame structure may extend on the outer surface of the container body from the container body opening edge downwards in the height direction (H) of the container and the sealing rim extends from the container body opening edge on the inner surface of the container body downward in the height direction (H) of the container and upward a distance past the container body edge in the height direction (H) of the container.

The sealing rim may be attached to the container wall by means of welding.

By joining the sealing rim to the inner surface of the container wall by means of welding, it is possible to obtain a tighter and slimmer attachment than is possible with an adhesive attachment. The welded sealing rim is preferably a plastic rim and connects the inner surface of the container wall with the inner surface of the container lid and contributes to create a continuous barrier from the container wall to the container lid. The weld seal forms a first seal between the sealing rim and the container wall and the first and second sealing surfaces form a second, gasketing seal between the sealing rim and the lid. The first seal is a permanent seal which is present at all times and the second seal is an openable seal which is present only when the lid is closed on the container access opening and the first and second sealing surfaces are pressed against each other.

The welding process provides a highly controlled way of creating an optimal join between the plastic sealing rim and the paperboard container wall. The join is made by supplying energy to heat and locally soften or melt one or more thermoplastic component in the plastic rim and/or on the inner surface of the container wall and by pressing the plastic rim and the container wall together in a direction perpendicular to the container wall. The thermoplastic material used to create the weld seal may be provided by the plastic rim, by a thermoplastic film or coating on the inner surface of the container wall, or by both the plastic rim and by a thermoplastic film or coating on the inner surface of the container wall. It may be preferred that the plastic rim is made from thermoplastic material. A thermoplastic rim may be produced by any suitable melt-forming process known in the art, such as injection molding. By controlling weld temperature, pressure and weld time, it is possible to adapt the welding process to the welded materials and to obtain a weld seam with a required level of tightness. Accordingly, the welding process is accurate and predictable and is an efficient way of producing a reliable seal with a predetermined level of tightness. A preferred welding method for the weld seal between the sealing rim and the paperboard packaging container body may be high frequency welding.

The sealing rim may have any suitable cross-sectional profile such as a generally !-shaped cross-sectional profile, a generally wedge-shaped or tapering cross-sectional profile or a cross-sectional profile in the form of an inverted L-shape with a first leg extending downward in the container on the inner surface of the container wall and a second leg extending over and covering the paperboard container wall edge. A generally I-shaped or L-shaped sealing rim may be preferred as it is easy to insert into the container body opening and to attach to the container wall by welding and application of pressure perpendicular to the container body wall.

The circumferential lid sealing member may be attached to the lid by adhesive or welding. However, it may be preferred that the circumferential lid sealing member is mechanically attached to the lid, such as by being snapped into a groove extending along the edge of the lid, on the inner surface thereof.

A paperboard packaging container as disclosed herein has an outer surface opposite the inner surface and a container body edge at the container opening. The frame structure may extend on the outer surface of the container body from the container body opening edge downwards in the height direction of the container and the sealing rim may extend from the container body opening edge on the inner surface of the container body downwards in the height direction of the container and upwards a distance past the container body edge in the height direction of the container. Thus, the sealing rim and the frame structure are arranged generally side-by-side with the sealing rim on the inner surface of the container body and the frame structure on the outer surface of the container body.

The sealing rim may protrude above the container body edge a distance which is at least 0.5 mm, such as from 1 mm to 7 mm, or from 2 mm to 5 mm.

In the packaging container as disclosed herein, the connection between the frame structure and the sealing rim may be a snap-in connection.

In addition to the openable and reclosable lid, the top end closure may comprise a transport closure which is attached to the inner surface of the container body at a distance from the container body edge at the top end of the container body. The transport closure is preferably attached to the inner surface of the container wall which is free from the fold lines and forms a cross-sectional transport seal between an interior storage compartment in the container body and the container opening and can be fully or partly removed by a user in order to provide initial access to the interior compartment either by breaking a seal between the transport closure and the inner surface of the container wall, or by tearing or otherwise breaking the transport closure itself. A tearable transport closure may be provided with one or more predefined weakenings, such as perforations or a cut partly through the transport closure. The transport closure may further be provided with a gripping tab, a pull ring, or other means for facilitating removal of the transport closure.

The transport closure may be inserted into the container body and attached to the inner surface of the container body either from the top end of the container body or from the bottom end of the container body. In order to gain a first access to the packaged goods in the inner compartment, a user opens the lid and exposes the packaged goods by fully or partly removing the transport closure. The paperboard packaging container may be a gas-tight container and the inner transport closure may be a gas-tight peelable or openable transport closure. The transport closure may be of any type as known in the art, and usually comprises a base layer such as a paper sheet, a plastic film or a metal foil which is coated or laminated with additional layers such as barrier layers, sealing layers, etc.

A peelable or tearable transport closure may be gastight or gas-permeable. A gastight transport closure may be manufactured from any material or material combination suitable for providing a gastight sealing of a compartment delimited by the transport closure, such as aluminium foil, silicon-coated paper, plastic film, or laminates thereof. A gastight transport closure is advantageous when the bulk solids stored in the packaging container are sensitive to air and/or moisture, and it is desirable to avoid contact of the packaged bulk solids with ambient air.

Plastic components such as the upper reinforcing rim and the container lid may comprise a high-barrier polymer material. The high-barrier polymer material may be present as an inner layer in the plastic component. A plastic component having excellent barrier properties may be formed by an injection-molding process where an inner layer of EVOH is formed in a polyolefin component such as polypropylene, PP, or polyethylene PE.

A packaging container having a volume of approximately 1l may be considered to be gas-tight if it provides an oxygen barrier of approximately 0.006 cc oxygen/24 h or less at 23° C. and 50% relative humidity.

In a second aspect, the present disclosure relates to a lid component comprising a lid and frame structure. The lid comprises a top portion and a side wall portion, the top portion having an outer lid surface and an inner lid surface opposite to the outer lid surface. A circumferential lid sealing member is further applied at the inner lid surface and the frame structure forms a closed loop. The lid is connected to the frame structure by a hinge member arranged at a first part of the frame structure, and a locking arrangement is arranged on the frame structure at a second part of the frame structure which is located opposite the first part of the frame structure. The locking arrangement comprises interengaging locking elements, wherein a first interengaging locking element is arranged in or on the outer lid surface of the lid top portion and a second interengaging locking element is arranged on or in a locking flap arranged on the frame structure and being hingedly connected to the frame structure by means of a hinge formed integrally with, or connected to, the frame structure. The circumferential lid sealing member is made from polymeric foam having a closed-cell structure, has a no-load thickness of from 1.5 to 5 mm and has a density of from 10 to 75 kg/m$^3$.

In the lid component disclosed herein, the circumferential lid sealing member may be a circumferential lid sealing member according to the first aspect.

Definitions

The packaging containers as disclosed herein are paperboard packaging containers wherein at least the container body is formed from a paperboard material. The paperboard material is provided in the form of a rectangular paperboard blank which is bent into a tubular shape, whereafter the tube is closed by joining overlapping or abutting side edges of the blank to form a body tube. Fold lines may be provided in the paperboard blank for promoting shaping of the closed body tube into a shape having distinct wall portions connected by distinct curved corner portions when the join between the side edges is formed using a sealing strip. Joining of the material edges may be made by any suitable method such as by adhesive or welding, with welding generally being preferred. The paperboard containers may comprise add-on components which are predominantly made from other materials such as reinforcing rims, a plastic, a lid, a spout, etc. Such add-on components may be made from plastic, metal, wood, etc.

As used herein, a paperboard material is a sheet material predominantly made from cellulose fibres or paper fibres. The paperboard material may be a single ply or multi ply material and may be a laminate comprising a base sheet made predominantly from cellulose fibres or paper fibres, and one or more layers of materials such as polymeric films and coatings, metal foil, etc. The polymeric films and coatings may include or consist of thermoplastic polymers. The paperboard material may be coated, printed, embossed, etc. and may comprise fillers, pigments, binders and other additives as known in the art. The paperboard materials as disclosed herein may also be referred to as cardboard or carton materials.

The packaging containers as disclosed herein may be containers for bulk solids. As used herein, the term "bulk solids" refers to a solid bulk material from which a desired amount of the product may be poured, scooped or taken by hand out of a packaging container. The bulk material may be dry or moist. The bulk solids which are suitable for packing in the paperboard packaging containers as disclosed herein include any material in the form of particles, granules, grinds, plant fragments, short fibres, flakes, seeds, pieces, etc.

The containers are generally disposable containers, which are discarded when they have been emptied of their contents.

The paperboard packaging container as disclosed herein may be a container for alimentary products such as infant formula, coffee, tea, rice, flour, sugar, cereals, soup powder, custard powder, pasta, snacks, or the like. Alternatively, the bulk solids may be non-alimentary, such as tobacco, detergent, fertilizer, chemicals or the like.

The bottom disc may be made from paperboard, plastic, metal, etc., as known in the art. The lid may, for instance, be made from plastic or metal or may be made from paperboard or from a paperboard/plastic laminate. Plastic lids may be preferred as they can be made rigid, durable and water resistant, and as they may be produced in any desirable shape by well-known production methods such as by injection molding.

The container body of the packaging container as disclosed herein may have four main body wall portions; a front wall portion arranged opposite a rear wall portion and two opposing side wall portions extending between the front wall portion and the rear wall portion. The body wall portions are connected at corners or corner portions which may be formed between planar surfaces arranged at right angles to each other or may be curved or bevelled corner portions providing the packaging container with a softer, slightly rounded appearance. Moreover, the shape of the body wall portions may deviate from a planar shape, with one or more of the body wall portions having an outward or inward curvature. When the container body has one or more outwardly curved body wall portion the curvature of any such body wall portion is always lesser than the curvature of any curved corner portion, i.e. a radius of curvature of a corner portion in the container body of the packaging container as disclosed herein is always smaller than any radius of curvature of a body wall portion. A transition between a corner portion and a body wall portion may be seen as a distinct change in curvature or may be seen as a continuous change in curvature.

Furthermore, the container body can be made without any distinct body wall portions and may have any suitable foot-print shape, such as circular, oval or elliptic.

The front wall portion of the container body wall may have an outwardly curved shape with a radius of curvature of from 70-500 mm. Thus, the container body may have a generally D-shaped cross-section. The outwardly curved front wall portion has the advantage of providing a relatively large and perceptible surface that may be used for a display function, e.g. for printing brand names, illustrations or instructions. Moreover, the container body having a generally D-shaped cross-section is space-saving, since it may be positioned close up to e.g. a kitchen wall or a cupboard wall.

The corner portions of the packaging container may be curved corner portions having a radius of curvature of from 15-100 mm.

In paperboard containers, there is a conflict between minimizing the amount of paperboard material used in the containers and making the containers sufficiently rigid to avoid that the containers are damaged or that they collapse, e.g. when stacked for transport and storage. It has been found that by making all container walls only slightly outwardly curved, shape stability and rigidity of the packaging container may be considerably improved as compared to conventional packaging containers having planar walls. Accordingly, the radii of curvature of the upper and lower end edges which govern the curvature of the container walls are preferably selected such that the container walls are provided with a near-planar shape, implying that the container walls are perceived by a consumer as being planar.

As set out herein, at least one of the container wall portions may have a radius of curvature of from 200 millimeters to 700 millimeters, such as from 300 to 500 millimeters implying that the container wall portion is near-planar. A near-planar wall portion is perceived by the naked eye as being planar when viewed from a normal viewing distance, such as when placed on a shelf. A packaging container having all body wall portions being near-planar is generally perceived as having a cuboid shape, i.e. the human eye will see the container body as having square or rectangular side walls and bottom.

A rigid plastic sealing rim as disclosed herein which is welded to the inner surface of the container body wall contributes to shape and stabilize the flexible paperboard container body opening edge and thereby ascertains that the container body wall is provided with a desired shape and in particular that the container body wall can be imparted with a predetermined and stable curvature. In a corresponding manner, when the packaging container as disclosed herein is provided with a bottom rim, the bottom rim further contributes to shape and stabilize the container body bottom edge and the container body wall. As set out herein, the packaging container may be provided with any desired tubular shape by bringing the body wall edge to conform to a rigid plastic upper reinforcing rim having the desired footprint shape. The container body shape can optionally be further stabilised by means of a rigid bottom rim having the desired footprint shape and being attached to the container body at the container bottom edge.

BRIEF DESCRIPTION OF THE DRAWINGS

The present invention will be further explained hereinafter by means of non-limiting examples and with reference to the appended drawings wherein.

DETAILED DESCRIPTION

It is to be understood that the drawings are schematic and that individual components, such as layers of material are not necessarily drawn to scale. The packaging container, sealing arrangement and circumferential lid sealing member shown in the figures are provided as examples only and should not be considered limiting to the invention. Accordingly, the scope of the invention is determined solely by the appended claims.

Figure 1:
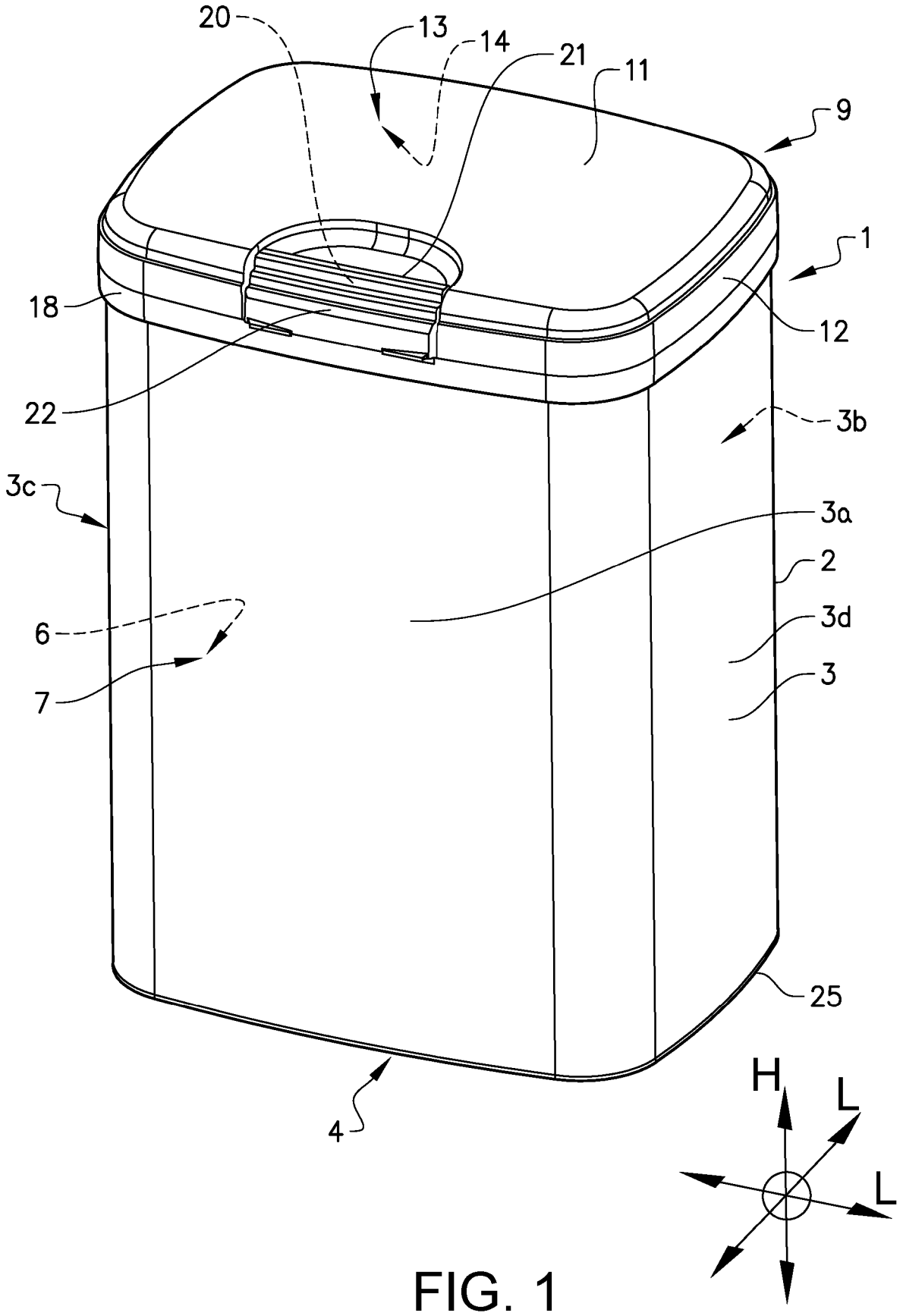
FIG. 1 illustrates a front view of a packaging container.
Figure 2:
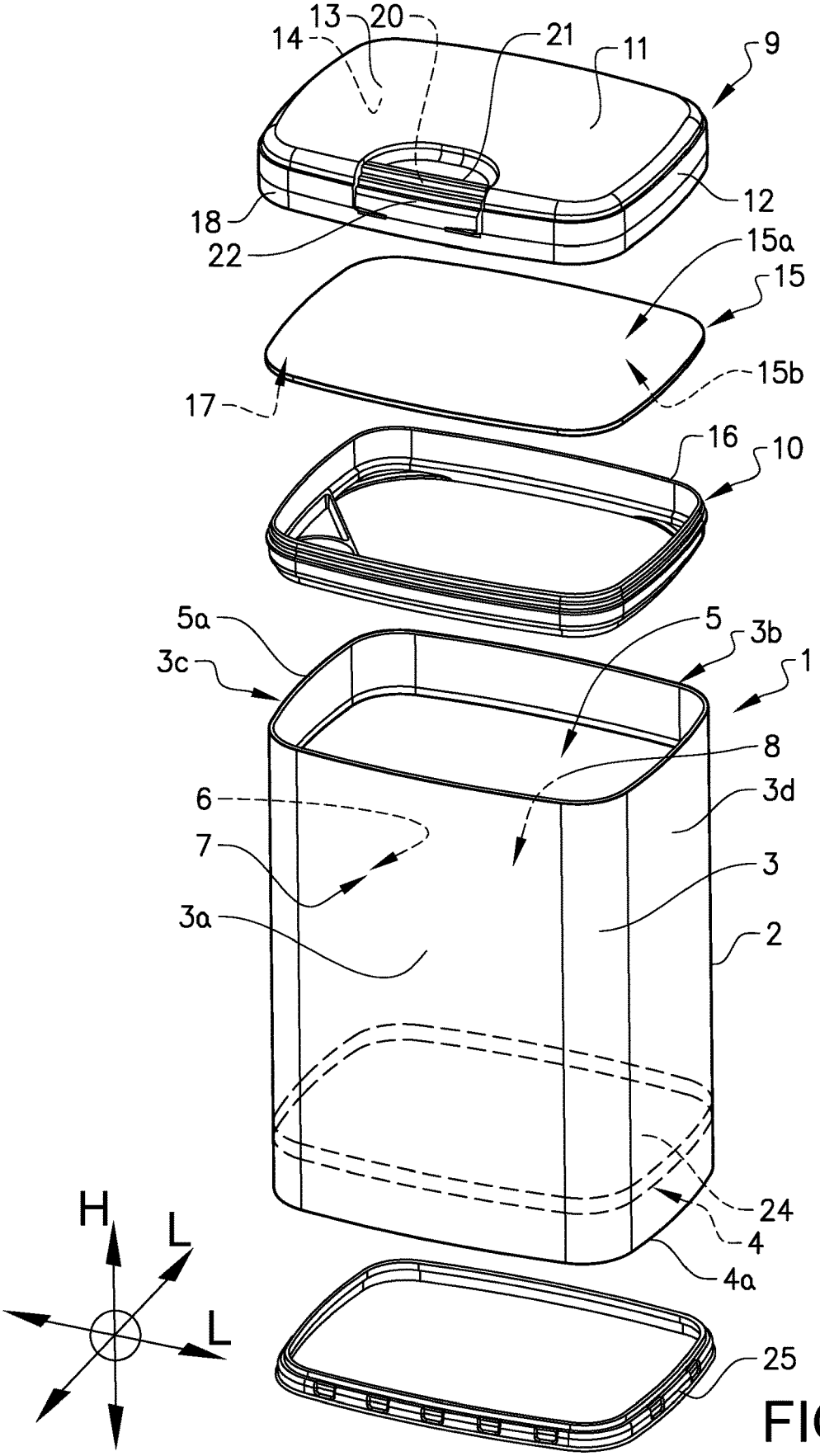
FIG. 2 illustrates an exploded view of the packaging container in FIG. 1.

With reference to FIGS. 1-2 there is shown a paperboard packaging container 1 for pourable or scoopable bulk solids. The particular shape of the container 1 shown in the figures should not be considered limiting to the invention. Accordingly, the paperboard packaging container according to the invention may have any useful shape or size.

With reference to FIGS. 1 and 2, the packaging container 1 comprises a container body 2 formed by a tubular container wall 3 including a front wall portion 3*a*, a rear wall portion 3*b* and two side wall portions 3*c*, 3*d*. The container wall 3 extends from a container body bottom edge 4*a* to a container body opening edge 5*a* at a container body opening 5 in a height direction H of the packaging container 1. The container wall 3 has an inner surface 6 facing towards an inner compartment 8 in the packaging container 1 and an outer surface 7 facing away from the inner compartment 8 and being exposed to the exterior of the packaging container 1. A bottom disc 24 is positioned at a container body bottom 4 of the container body 2. The container body 2 is made from paperboard material as defined herein. The container body 2 may be formed by bringing together the side edges of a web of paperboard causing the material to assume a tubular shape, where after the side edges are sealed together. Sealing of the side edges may be made by any suitable method as known in the art, such as by welding or gluing, with welding being preferred. Sealing of the side edges of the container body web may involve using a sealing strip, as known in the art. The bottom disc 24 may be made from paperboard, metal, plastic, or from any suitable combination of such materials as known in the art.

The container body bottom edge 4*a* is reinforced by a plastic bottom rim 25 which is applied to the inner surface 6 of the container wall 3, between the bottom disc 24 and the container body bottom edge 4*a*. The bottom rim 25 reinforces the container body paperboard bottom edge 4*a*, stabilizes the shape of the container body 2 and protects the container body bottom edge 4*a* from mechanical deformation. The plastic bottom rim 25 also serves as a protective barrier against water and other fluids which may be present on a surface on which the packaging container is placed.

As an alternative to a plastic bottom rim, the bottom edge of the packaging container may be formed by a rolled edge of the paperboard container body, or may be provided by a simple, non-rolled join between the bottom disc 24 and the container body 2.

The paperboard packaging container 1 is provided with a sealing arrangement comprising a lid 9 and a sealing rim 10 extending along the container body opening 5 and defining a perimeter of a container access opening which is smaller than the container body opening which is defined by the container opening edge 5*a* of the container body 2.

The sealing rim 10 is preferably a plastic rim, most preferably a thermoplastic rim and is attached to the inner surface 6 of the container body wall 3 at the container body opening 5. The sealing rim 10 has an extension in the height direction, H, of the container 1 and has an upper end edge defining a first sealing surface 16 facing away from the container bottom 4. The sealing rim 10 extends around the full periphery of the container body opening 5. The sealing rim 10 protrudes upwards in the height direction, H, above the container body opening edge 5*a*, whereby the first sealing surface 16 of the sealing rim 10 is arranged above the container body opening edge 5*a* in the height direction, H, of the packaging container 1.

The sealing rim 10 is joined to the inner surface 6 of the container wall 3 by means of a weld seal extending around the container opening 5. The weld seal preferably extends continuously around the container body opening 5 and is a sift-proof weld seal and is preferably also a moisture proof weld seal and most preferably a gas-tight weld seal.

The weld seal is formed by supplying energy to heat and locally soften or melt one or more thermoplastic component in a thermoplastic sealing rim 10 and/or in a coating or film on the inner surface 6 of the container body wall 3 and by pressing the sealing rim 10 and the container wall 3 together in a direction perpendicular to the container wall 3. The temperature and pressure can be controlled and adjusted to form a strong and tight seal without damaging the welded components. The thermoplastic material used to create the weld seal may be provided by a fully or partly thermoplastic sealing rim 10, by a thermoplastic film or coating on the inner surface 6 of the container wall 3, or by both a fully or partly thermoplastic reinforcing rim and by a thermoplastic film or coating on the inner surface 6 of the container wall 3. A plastic sealing rim 10 is preferably made from thermoplastic material which allows it to be thermoformed, e.g. by injection molding. An injection molding process may be used to form plastic components having different polymer compositions in different parts of the plastic component. By way of example, the surface of a plastic sealing rim which is welded to the container body may be formed from a polymer composition having a lower softening and melting point than other parts of the reinforcing rim. Moreover, a sealing surface on the upper sealing rim 10 may be formed from a resilient thermoplastic polymer. Any suitable welding technique may be used, such as ultrasonic welding or high frequency welding, with high frequency welding being preferred.

The lid 9 comprises a top portion 11 and a side wall portion 12. The top portion 11 of the lid defines an outer lid surface 13 and an inner lid surface 14. A circumferential lid sealing member 15 in the form of a lid sealing disc 15 is applied in the lid 9 against an inner lid support surface 14*a* (illustrated in FIG. 3), with a lid sealing disc first side 15*a* facing the inner lid surface 14 and a lid sealing disc second side 15*b* facing away from the inner lid surface 14. The sealing disc 15 is applied in the lid 9 with a lateral compression against the side wall portion 12 such that lateral tension through the lid sealing disc 15 is created.

Figure 3:
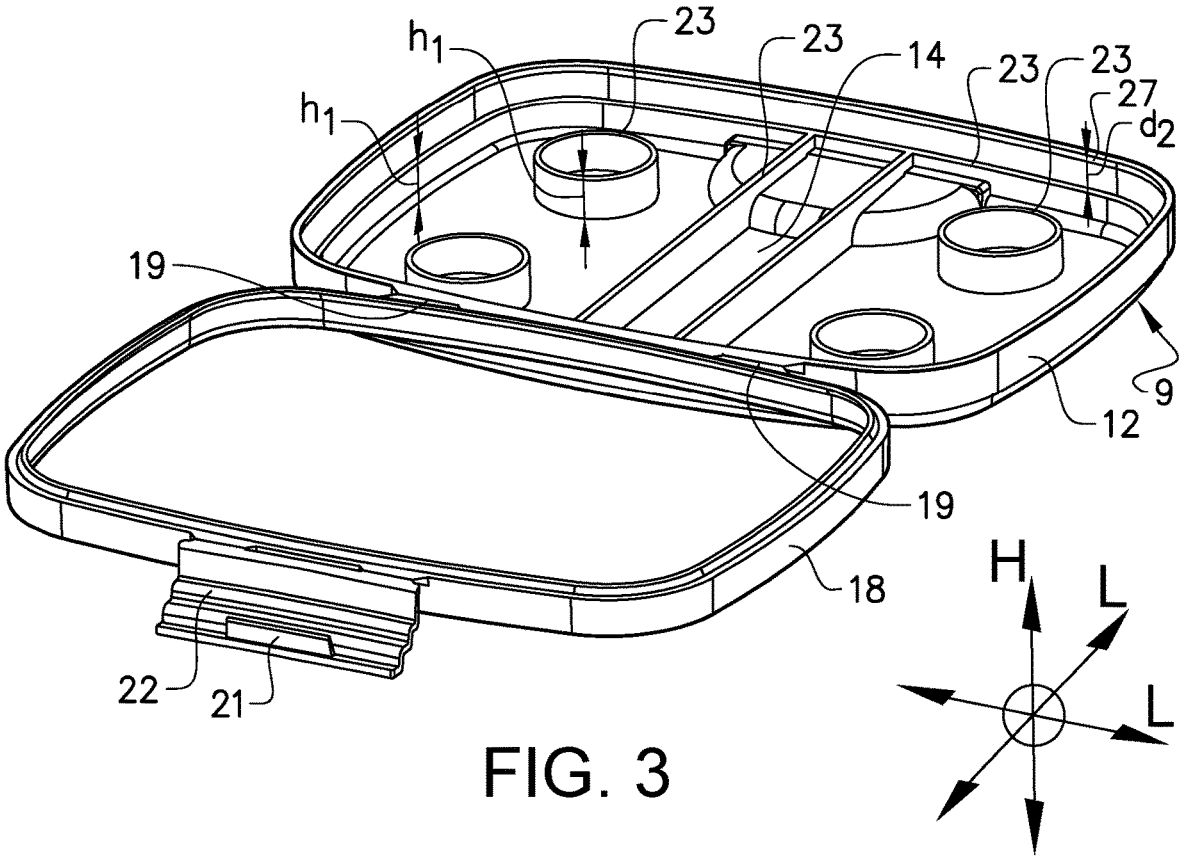
FIG. 3 illustrates a container lid.

As illustrated in FIG. 3, a sealing member support element 23 is arranged on, and form part of, the inner surface 14 of the lid 9 and is in the form of a closed loop extending in parallel with the lid side wall portion 12. The distance d1 is measured from the inner lid support surface 14*a*, i.e. from the surface facing and supporting the sealing disc 15 when the sealing disc 15 is arranged in the lid 9 according to the present disclosure. In FIG. 3, the sealing member support element 23 includes a pattern of reinforcing ribs and tubular elements, providing supporting to the lid sealing disc 15. The inner lid support surface 14*a* is in the form of a closed loop extending in parallel with the lid side wall portion 12 is arranged such that when the lid 9 is in a closed position the closed loop and the sealing rim 10 exert pressure on the lid sealing disc 15 from opposite directions which will provide even further improved sealing properties of the packaging container 1. The inner side of the side wall portion 12 is also provided with a protruding rib 27 for holding the sealing disc 15 in place, in the form of a closed loop extending along the lid side wall portion 12 and protruding perpendicularly from the side wall portion 12.

In FIG. 3, the lid 9 is connected by a hinge member 19 to the frame structure 18. The hinge member 19 is arranged at a first part of the frame structure 18 and a locking arrangement in the form of a locking flap 22 is arranged on the frame structure 18 at a second part of the frame structure 18. The second part of the frame structure 18 is located opposite the first part of the frame structure 18.

With reference to FIG. 3, the hinge member 19 is shown to be a live hinge, formed integrally with the lid 9 and the frame structure 18 as a flexible connection between the lid 9 and the frame structure 18. As set out herein, the illustrated hinge is only intended as a non-limiting example and it should be understood that any other type of functional hinge may be used for the connection between the frame structure and the lid.

The frame structure 18 is applied to the packaging container 1 at the container body opening edge 5*a* and is mechanically attached to the sealing rim 10 by a snap-on connection. The frame structure 18 is attached to the sealing rim 10 after the sealing rim 10 has been welded to the inner surface 6 of the paperboard container wall 3. Accordingly, the frame structure can be attached at a late stage in a process for assembling and filling the packaging container as disclosed herein. The frame structure 18 is applied to the sealing rim 10 by pressing the frame structure 18 down over the upper edge of the sealing rim 10 until the frame structure 18 locks in place on the sealing rim 10. When the frame structure 18 has been attached to the sealing rim 10, it can only be removed again by breaking or damaging the connection.

Figure 4:
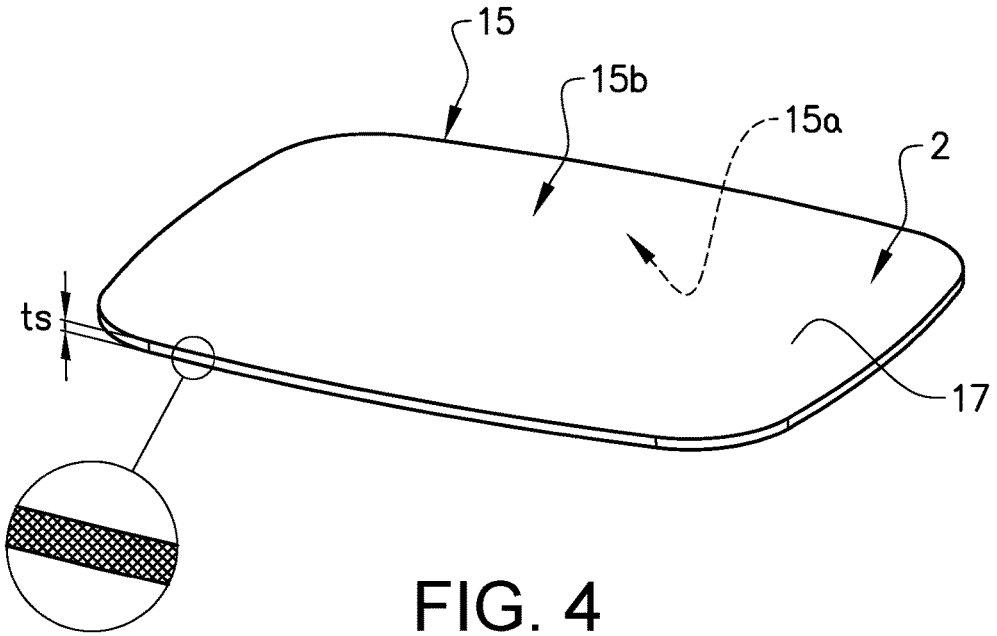
FIG. 4 illustrates a circumferential lid sealing member.

FIG. 4 illustrates the lid sealing disc 15 according to the present disclosure; the thickness $t_0$ is measured without applying any load, and is in the range from 1.5 to 5 mm. The lid sealing disc 15 has a uniform thickness.

Figure 5:
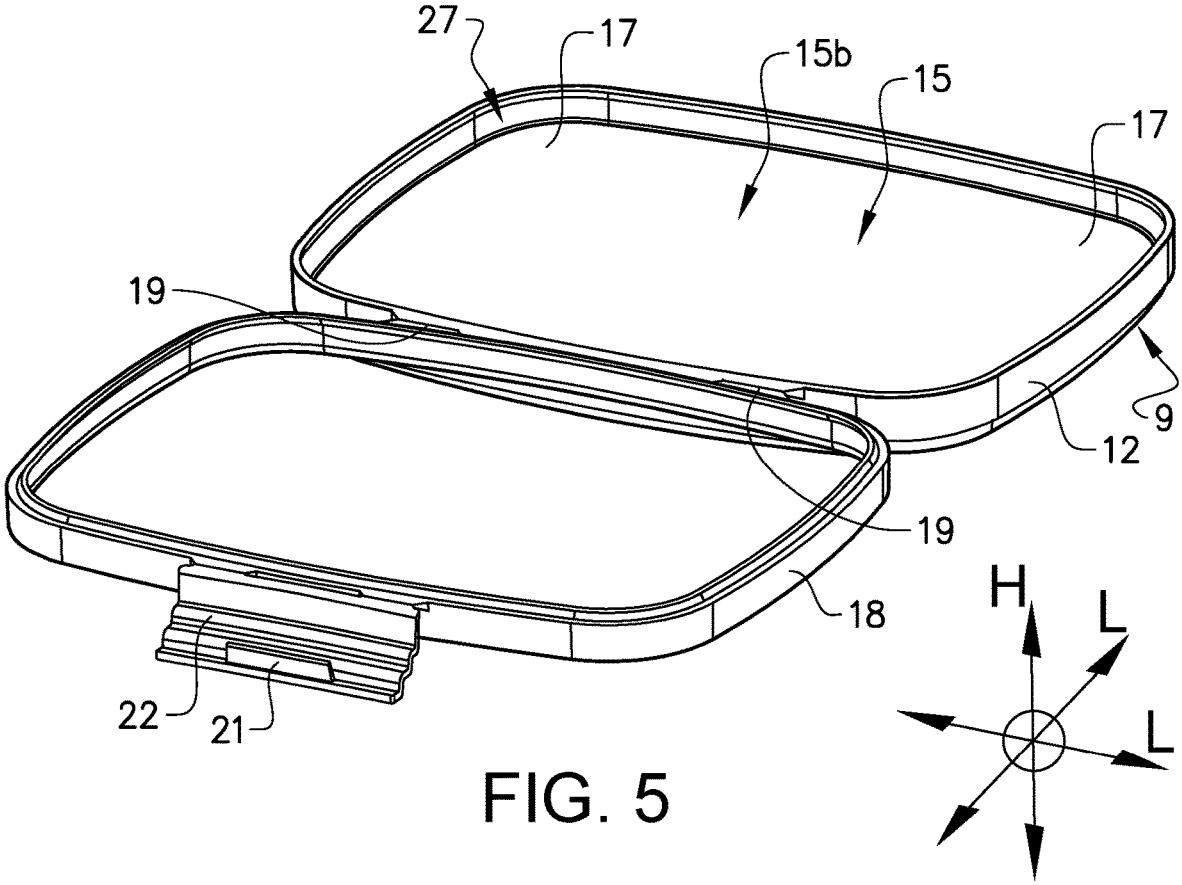
FIG. 5 illustrates a lid comprising a circumferential lid sealing member.
Figure 6:
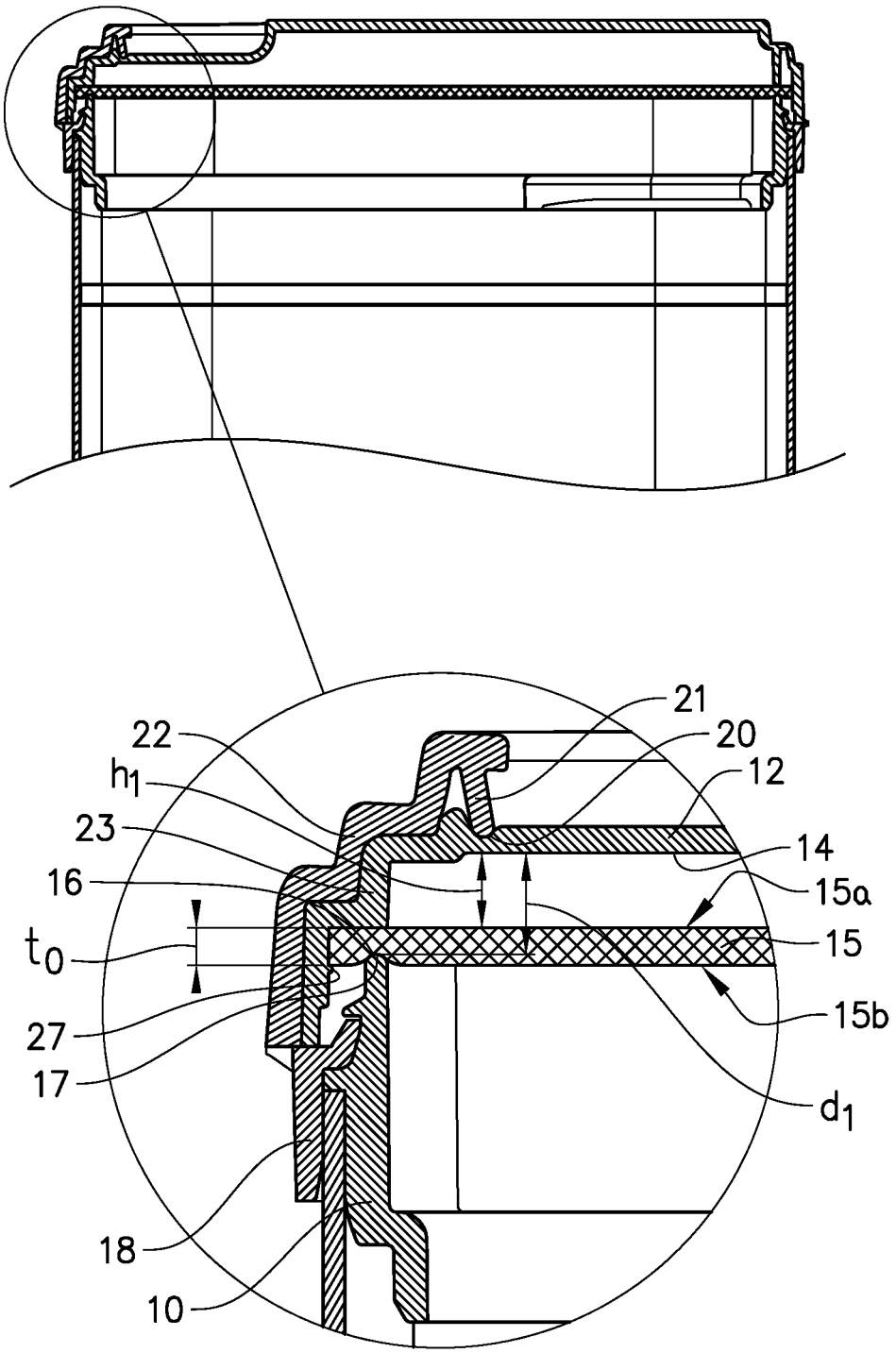
FIG. 6 illustrates a detail of a container body edge with an attached sealing rim, lid and a circumferential lid sealing member

As illustrated in FIGS. 5 and 6, the lid sealing disc 15 is applied in the lid 9 and being supported by the inner lid support surface 14*a* (shown in FIG. 3), with the sealing disc first side 15*a* facing the inner lid surface 14 (shown in FIG. 3), and the sealing disc second side 15*b* facing away from the inner lid surface 14. The lid sealing disc 15 is made from polyethylene foam having a closed-cell structure, it has a no-load thickness in the range of from 1.5 mm to 5 mm and a density in the range of from 10 to 75 kg/m$^3$. The lid sealing disc 15 also provides a second sealing surface 17 which will seal against the first sealing surface 16 arranged at the upper end edge of the sealing rim 10 when the lid 9 is in a closed position. A tight closure between the lid 9 and the container body 2 is thereby provided by the first sealing surface 16 on the upper rim edge and a corresponding second sealing surface 17 arranged on the lid sealing disc 15 provided in the lid 9.

In order to keep the lid 9 secured in the closed position between dispensing occasions and to exert pressure on the lid sealing disc 15 upon closure of the lid 9, the sealing arrangement further comprises a locking arrangement, as seen in FIGS. 1-3 and 5-6. The locking arrangement comprises mating locking elements. A male locking element 21 is arranged on the locking flap 22 and a female locking element 20 is arranged in the outer lid surface 13 of the lid top portion 11. The male locking element 21 is constituted by one or more protrusions, such as one or more knobs or ribs arranged on the locking flap 22 and the female locking element 20 is constituted by one or more corresponding cavities or grooves arranged in the outer lid surface 13 of the lid top portion 11. The locking arrangement is preferably designed such that it exerts a force on the connection between the lid 9 and the upper rim edge by pressing the first and second sealing surfaces 16, 17 together. The interengaging locking elements may however be in the form of any type of suitable deformable snap-fit locking elements.

With particular reference to FIG. 6 which illustrates the coupling between the sealing rim 10 and the frame structure 18, the sealing rim 10 is permanently attached to the inner surface 6 of the container wall 3 with a weld seam, such that a lower edge of the sealing rim 10 is facing downward in the height direction H and with the upper part of the sealing rim 10 protruding past the upper edge 5 of the container wall 3. The upper end edge of the sealing rim 10 forms a first sealing surface 16 which presses against a second sealing surface 17 constituted by the outer edge portion of the lid sealing disc 15 on a lid sealing disc second surface 15*b* facing the first sealing surface 16. Accordingly, the lid 9 closes on the packaging container 1 by forming a tight seal between the sealing rim 10 and the lid sealing disc 15, while the frame structure 18 provides attachment for the lid 9, and can be shaped and configured for carrying hinge elements, locking elements and stacking means without any concern for providing a tight closure between the lid and the container.

FIG. 6 shows the frame structure 18 with the locking flap 22 arranged thereon and the outwardly protruding male locking element 21 which is arranged to engage with a female locking element 20 in the form of a recess arranged in the outer lid surface 13 of the lid top portion 11. The lid sealing disc 15 is applied at the inner lid surface 14 and against the inner lid support surface 14*a*, with a sealing disc first surface 15*a* facing the inner lid surface 14 and the sealing disc second surface 15*b* facing away from the inner lid surface 14. A protruding rib 27 extends along at least a substantial part of the circumference of the side wall portion 12 on an inner side thereof, and the sealing disc 15 is kept in place by means of the protruding rib 27. The protruding rib 27 is arranged at a distance $d_2$ from the inner lid support surface 14*a*, corresponding to the thickness of the disc $t_0$ or being slightly smaller. When the lid 9 is in a closed position and the lid 9 has been pressed down over the sealing rim 10 and the male locking element 21 has snapped into a locking engagement with the female locking element 20, the first sealing surface 16 will press against the second sealing surface 17 of the lid sealing disc 15 such that the lid sealing disc 15 forms a tight sealing between the sealing rim 10 and the lid 9.

The shape of the packaging container as disclosed herein is not limited to the generally rectangular shape with rounded corners which is shown in FIGS. 1 and 2. The container body may also have a generally D-shaped footprint with an outwardly curved front wall portion and curved corners. The packaging container may also for example be generally squared, circular, triangular or oval.

The rigid plastic sealing rim 10 as disclosed herein which is welded to the inner surface 6 of the container body wall 3 contributes to shape and stabilize the container body opening edge 5 and also ascertains that the container body wall is provided with a desired shape and in particular that the container body wall can be imparted with a predetermined and stable curvature. In a corresponding manner, when the packaging container as disclosed herein is provided with a bottom rim 25, the bottom rim 25 further contributes to shape and stabilize the container body bottom edge 4*a*.

Any plastic component in the packaging container as disclosed herein such as a upper sealing rim and a lower reinforcement rim, a lid component, and a frame structure may be formed from thermo-formable or moldable plastic materials, e.g. by injection molding. Injection molding is particularly suitable for producing plastic components having a three-dimensional structure, such as the lid 9 and frame structure 18 shown in FIG. 3.

It should be understood that the outer three-dimensional shape of the lid may be different from that shown in the figures.

The invention claimed is:

1. A paperboard packaging container, said packaging container comprising a container body said container body comprising a container wall extending from a container bottom to a container opening in a height direction of said packaging container, and a sealing arrangement comprising a lid and a sealing rim, said lid comprising a top portion and a side wall portion, said top portion having an outer lid surface and an inner lid surface opposite to said outer lid surface, said packaging container comprising a circumferential lid sealing member applied in said lid against an inner lid support surface, said sealing rim forming a closed loop extending around said container opening and being attached to an inner surface of said container wall at said container opening and comprising a first sealing surface arranged at an upper end edge of said sealing rim and being arranged to seal against a second sealing surface constituted by said circumferential lid sealing member when said lid is in a closed position, said sealing arrangement further comprising a frame structure, said frame structure forming a closed loop extending around a periphery of said container opening and being connected to said sealing rim, said lid being connected to said frame structure by a hinge member arranged at a first part of said frame structure and a locking arrangement being arranged on said frame structure at a second part of said frame structure, which is located opposite said first part of said frame structure, said locking arrangement comprising interengaging locking elements, wherein a first interengaging locking element is arranged in or on said outer lid surface of said lid top portion and a second interegaging locking element is arranged on or in a locking flap arranged on said frame structure and being hingedly connected to said frame structure by means of a hinge formed integrally with, or connected to, said frame structure, said circumferential lid sealing member being made from a polymeric foam having a closed-cell structure, has a no-load thickness to of from 1.5 to 5 mm and a density of from 10 to 75 kg/m$^3$ and in that a distance $d_1$ is defined between said first sealing surface of said sealing rim and said inner lid support surface when said lid is in a closed position and wherein $t_0 > d_1$ and wherein said lid sealing member is applied in said lid with a lateral compression against said side wall portion such that the lid sealing member bulges toward the first sealing surface and a compression force of the first sealing surface against the second sealing surface of the lid sealing member when the lid is in the closed position increases.

2. The paperboard packaging container according to claim 1, wherein said sealing arrangement of said paperboard packaging container has no visual leakage present upon visual inspection at the seal between said first and said second sealing surfaces around the periphery of the container opening after a Sealing Arrangement Integrity Test that includes the following steps;

a) cutting out a hole with a 2 cm hole diameter in said bottom of a paperboard packaging container according to claim 1, b) placing said paperboard packaging container up-side-down with said lid being in a closed position, c) pouring water having a temperature of 24° C. into said paperboard packaging container through said hole such that a water column of 20 mm is formed, d) let said paperboard packaging container stand up-side-down for 5 min.

3. The paperboard packaging container according to claim 1, wherein said closed-cell polymeric foam is polyethylene foam.

4. The paperboard packaging container according to claim 3, wherein the polyethylene foam is closed-cell polyethylene foam.

5. The paperboard packaging container according to claim 1, wherein said circumferential lid sealing member has a no-load thickness of at least 2.0 mm.

6. The paperboard packaging container according to claim 5, wherein the no-load thickness is from 2.0 to 4.0 mm.

7. The paperboard packaging container according to claim 1, wherein a support structure comprising a sealing member support element is arranged on said inner lid surface and forming said inner lid sealing surface, said inner lid sealing surface forming a closed loop and extending in parallel with said lid side wall portion and further being arranged such that when said lid is in a closed position said sealing member support element and said sealing rim exerts pressure on said circumferential lid sealing member from opposite directions.

8. The paperboard packaging container according to claim 1, wherein said container body has an outer surface opposite said inner surface and a container body edge at said container opening, said frame structure extending on said outer surface of said container body from said container body opening edge downwards in said height direction of said container and said sealing rim extending from said container body opening edge on said inner surface of said container body downward in said height direction of said container and upward a distance past said container body edge in said height direction of said container.

9. The paperboard packaging container according to claim 8, wherein said distance past said container body edge is at least 0.5 mm.

10. The paperboard packaging container according to claim 9, wherein said distance past said container body edge is from 1 mm to 7 mm.

11. The paperboard packaging container according to claim 10, wherein said distance past said container body edge is from 2 mm to 5 mm.

12. The paperboard packaging container according to according to claim 1, wherein said frame structure is connected to said sealing rim by a snap-in connection.

13. The paperboard packaging container according to claim 1, wherein a Compression set ($C_{SET}$) of the lid sealing member at 25% compression under 22 h at 23° C., is between 10 and 20% as measured after ½ h recovery and according to standard method BS ISO 7212, 1998, the Compression set being calculated as $C_{SET}=[(t_0-t_i)/(t_0-t_n)]*100$ where $t_i$ is the sealing member thickness after testing and to is the thickness of the specimen during the test.

14. The paperboard packaging container according to claim 13, wherein said distance $d_1$ is smaller than said thickness $t_i$.

15. The paperboard packaging container according to claim 14, wherein said distance $d_1$ is at least 2% smaller than said thickness $t_i$.

16. The paperboard packaging container according to claim 15, wherein said distance $d_1$ is at least 5% smaller than said thickness $t_i$.

17. The paperboard packaging container according to claim 1, wherein said circumferential lid sealing member is a lid sealing member.

18. The paperboard packaging container according to claim 1, wherein said interengaging locking elements are mating locking elements, said first interengaging locking element being a female locking element and said second interengaging locking element being a male locking element.

19. A lid component comprising a lid and frame structure, said lid comprising a top portion and a side wall portion, said top portion having an outer lid surface and an inner lid surface opposite to said outer lid surface, said packaging container comprising a circumferential lid sealing member applied in said lid against an inner lid support surface, said frame structure forming a closed loop and said lid being connected to said frame structure by a hinge member arranged at a first part of said frame structure, and a locking arrangement being arranged on said frame structure at a second part of said frame structure which is located opposite said first part of said frame structure, said locking arrangement comprising interengaging locking elements, wherein a first interengaging locking element is arranged in or on said outer lid surface of said lid top portion and a second interengaging locking element is arranged in or on a locking flap arranged on said frame structure and being hingedly connected to said frame structure by means of a hinge formed integrally with, or connected to, said frame structure, wherein said circumferential lid sealing member is made from a polymeric foam having a closed-cell structure, has a no-load thickness of from 1.5 to 5 mm and a density of from 10 to 75 kg/m$^3$ and wherein said lid sealing member is applied in said lid with a lateral compression against said side wall portion;

wherein the lid component is for cooperating with a sealing rim to at least partially compress the circumferential lid sealing member between the inner lid support surface and at least a portion of the sealing rim when the lid is in a closed position, and wherein the lateral tension increases a compression force on the circumferential lid sealing member between the inner lid support surface and the sealing rim when the lid is in the closed position.

* * * * *